US008995705B2

(12) United States Patent
van Reeuwijk et al.

(10) Patent No.: US 8,995,705 B2
(45) Date of Patent: Mar. 31, 2015

(54) MULTI-LAYER ARMATURE FOR MOVING ARMATURE RECEIVER

(75) Inventors: Sietse Jacob van Reeuwijk, Soest (NL); Theodorus Geradus Maria Brouwer, Heemsteded (NL); Adrianus Maria Lafort, Delft (NL); Mikhail Joerjevitsj Korneev, Amsterdam (NL)

(73) Assignee: Sonion Nederland B.V., Hoofddorp (NL)

( * ) Notice: Subject to any disclaimer, the term of this patent is extended or adjusted under 35 U.S.C. 154(b) by 461 days.

(21) Appl. No.: 13/325,306

(22) Filed: Dec. 14, 2011

(65) Prior Publication Data

US 2012/0155694 A1 Jun. 21, 2012

Related U.S. Application Data

(60) Provisional application No. 61/422,920, filed on Dec. 14, 2010.

(51) Int. Cl.
*H04R 25/00* (2006.01)
*H04R 11/02* (2006.01)

(52) U.S. Cl.
CPC ..... *H04R 11/02* (2013.01)
USPC ..... 381/418; 381/417; 381/176

(58) Field of Classification Search
CPC ... H04R 11/02; H04R 2209/024; H04R 31/00
USPC ..... 381/176, 322, 324, 417, 418
See application file for complete search history.

(56) References Cited

U.S. PATENT DOCUMENTS

| | | | | |
|---|---|---|---|---|
| 3,617,653 | A | 11/1971 | Tibbetts | |
| 3,826,733 | A * | 7/1974 | Cragg | 381/417 |
| 6,563,933 | B1 * | 5/2003 | Niederdraenk | 381/417 |
| 7,443,997 | B2 | 10/2008 | Miller et al. | |
| 2004/0151340 | A1 | 8/2004 | Miller | |
| 2010/0054509 | A1 | 3/2010 | Thompson | |

FOREIGN PATENT DOCUMENTS

EP 1353531 A2 10/2003

OTHER PUBLICATIONS

European Search Report corresponding to co-pending European Patent Application Serial No. EP 111929777.4, European Patent Office, dated Dec. 10, 2012; (2 pages).

* cited by examiner

*Primary Examiner* — Brian Ensey
(74) *Attorney, Agent, or Firm* — Nixon Peabody LLP

(57) ABSTRACT

A multi-layer armature for a moving armature receiver. The armature includes a first armature layer and a displacement region. The first armature layer includes a first surface and a second armature layer having a second surface positioned adjacent to the first surface. The displacement region provides relative displacement between the armature layers.

20 Claims, 3 Drawing Sheets

MULTI-LAYER ARMATURE FOR MOVING ARMATURE RECEIVER

CROSS-REFERENCE TO RELATED APPLICATIONS

This application claims the benefit of U.S. Provisional Patent Application Ser. No. 61/422,920, filed Dec. 14, 2010, and titled "Multi-Layer Armature for Moving Armature Receiver," which is incorporated herein by reference in its entirety.

FIELD OF THE INVENTION

The present invention relates to armatures for moving armature receivers such as miniature balanced armature receivers for portable communication devices. More specifically, the invention relates to a multi-layer armature for a moving armature receiver comprising a first armature layer comprising a first surface and a second armature layer comprising a second surface positioned adjacently to the first surface. A displacement region of the multi-layer armature is configured to provide relative displacement between the first and second armature layers in a predetermined direction.

BACKGROUND OF THE INVENTION

Moving armature receivers are widely used to convert electrical audio signals into sound in portable communication applications such as hearing instruments, headsets, in-ear-monitors, earphones etc. Moving armature receivers convert the electrical audio signal to sound pressure or acoustic energy through a motor assembly having a movable armature. The armature typically has a displaceable end or region that is free to move while another portion is fixed to a housing or magnet support of the moving armature receiver. The motor assembly includes a drive coil and one or more permanent magnets, both capable of magnetically interacting with the armature. The movable armature is typically connected to a diaphragm through a drive rod or pin placed at the deflectable end of the armature. The drive coil is electrically connected to a pair of externally accessible drive terminals positioned on a housing of the miniature moving armature receiver. When the electrical audio signal is applied to the drive coil the armature is magnetized in accordance with the audio signal. Interaction of the magnetized armature and a magnetic field created by the permanent magnets causes the displaceable end of the armature to vibrate. This vibration is converted into corresponding vibration of the diaphragm due to the coupling between the deflectable end of the armature and the diaphragm so as to produce the sound pressure. The generated sound pressure is typically transmitted to the surround environment through an appropriately shaped sound port or spout attached to the housing or casing of the movable armature receiver.

A maximum sound pressure output of a moving armature receiver is created by maximum displacement, or deflection, of the armature as it vibrates. The maximum deflection is set by a maximum magnetic flux carrying capacity of the armature and its mechanical stiffness. A higher magnetic flux means that larger magnetic forces are generated to displace the armature. With increasing mechanical stiffness of the armature, more magnetic flux is needed to displace the armature. The maximum magnetic flux carrying capacity is constrained by material properties of the armature and a cross-sectional area of the armature. The latter property also influences the mechanical stiffness which increases with increasing cross-sectional area. Thus, merely increasing the cross-sectional area of the armature does not provide a significant improvement in the maximum deflection of the armature.

U.S. Pat. No. 7,443,997 discloses an armature for a receiver with a connection portion in communication with first and second leg portions. The connection portion has a width greater than the width of the first and second leg portions individually but a thickness less than the thickness of each of the first and second leg portions to reduce the stiffness of the armature.

The present invention is based on a multi-layer construction of the armature where adjacently arranged armature layers are at least partly magnetically coupled to each other while allowing relative mechanical displacement over at least a segment or portion of the armature layers. This multi-layer construction creates considerable design freedom in choosing armature geometry outside the bounds posed by the above-mentioned conventional constraint between armature cross-sectional area and mechanical stiffness. The design freedom can be applied to create numerous performance benefits for the moving armature receiver such as higher electroacoustic conversion efficiency, increased maximum sound pressure output or decreased length of the armature and thus size of the moving armature receiver.

SUMMARY OF INVENTION

A first aspect of the invention relates to a multi-layer armature for a moving armature receiver comprising:

a first armature layer comprising a first surface and a second armature layer comprising a second surface positioned adjacently to the first surface, a displacement region configured to provide relative displacement between the first and second armature layers in a predetermined direction. The multi-layer construction of the present armature in combination with the displacement region creates considerable design freedom in choosing armature geometry outside conventional bounds posed by the above-mentioned constraint between armature cross-sectional area and its mechanical stiffness. The design freedom can be applied to create numerous performance benefits for the moving armature receiver such as higher electroacoustic conversion efficiency, increased maximum sound pressure output or smaller overall length of the multi-layer armature compared to prior art armatures. The smaller length leads to a smaller size of moving armature receivers which is an important performance metric for moving armature receivers for numerous severely size-constrained applications such as hearing instruments, in-ear-monitors, etc.

In a number of advantageous embodiments of the present multi-layer armature the displacement region comprises:

a curved segment of the first armature layer and a curved segment of the second armature layer. The curved segments have different length. The length difference between the curved segments is set to provide a gap between these where relative displacement between the first and second armature layers is possible. In one specific embodiment, each of the curved segments is formed as a semicircle spanning around 180 degrees. The distance or gap between the adjacently positioned first and second surfaces may vary along the curved displacement region such as from about 10 μm to about 100 μm or the distance may be essentially constant.

In one embodiment, each of the first and second armature layers comprises first and second substantially parallel leg portions mechanically and magnetically coupled to the curved segments of the displacement region to form a substantially U-shaped multi-layer armature geometry or outline. The curved segments are preferably shaped as respective semicircular segments and both of the first and second leg portions shaped as respective flat bars with rectangular cross-sectional profiles.

In another embodiment, each of the first and second armature layers comprises a flat elongate armature leg having a distant leg portion and a proximate leg portion. The curved segments of the first and second armature layers are formed as respective bumps or protuberances on the proximate leg portion. The bumps may have an extension between from about 100 μm to 300 μm measured along a longitudinal plane of the flat elongate armature leg. A multi-layer armature in accordance with this embodiment may have an overall E-shaped geometry or outline where each of the first and second armature layers comprises first, second and third substantially parallel leg portions mechanically and magnetically coupled to each other through a coupling leg. The first, second and third substantially parallel leg portions project substantially orthogonally from a longitudinal axis of the coupling leg or "back." The flat elongate armature leg preferably forms a middle or central leg of the "E." The distant leg portion is rendered highly deflectable, compared to a corresponding leg portion of a conventional E-shaped armature with similar dimensions, by the decrease of mechanical stiffness caused by the relative motion or displacement between the curved segments of first and second armature layers.

In certain useful embodiments of the invention, the displacement region comprises a gap separating the first and second surfaces of the first and second armature layers. The gap may have a height which on one hand is large enough to allow relatively free movement or displacement between the first and second armature layers along the predetermined direction while on the other hand small enough to maintain good magnetic coupling between the first and second armature layers. The gap height or distance between the first and second surfaces in the displacement region preferably lies between 0.1 μm and 100 μm such as between 10 μm and 100 μm in multi-layer armature embodiments based on the above-mentioned curved segments of different length. The gap height may be essentially constant throughout the displacement region or the air gap height may vary within the displacement region depending on its geometry and size. The gap may exclusively comprise atmospheric air to provide an air gap or the gap may comprise a displacement agent, other than atmospheric air, arranged in-between the first surface of the first armature layer and the second surface of the second armature layer.

In a number of advantageous embodiments, the displacement agent comprises a ferromagnetic material or substance to provide enhanced magnetic coupling between the first and second armature layers throughout the displacement region. Such strong magnetic coupling between the first and second armature layers minimizes magnetic reluctance between the first and second armature layers and secures that they jointly provides essentially the same magnetic reluctance as a single armature segment with the corresponding cross-sectional area. Generally, the displacement agent may comprise a variety of different magnetically conductive or non-conductive materials or combinations thereof such as a material selected from a group of {polymer, gel, ferrofluid, adhesive, thin film}. Outside the displacement region surface portions of the first and second surfaces may be rigidly attached to each other for example by welding, soldering, gluing, press fitting, etc. This ensures inter alia good magnetic coupling between the first and second armature layers and a coherent and robust armature construction despite the layered or laminated structure.

In another embodiment of the invention, the displacement region extends between the first and second surfaces throughout entire adjacent surface areas of the first and second armature layers. The first and second surfaces are preferably essentially flat to allow adjacent placement thereof. According to this embodiment, the entire first and second armature layers may be displaceable relative to each other along the predetermined direction. The predetermined direction is preferably substantially parallel to the first and second surfaces. In one such embodiment, each of the first and second armature layers comprises first, second and third substantially parallel leg portions mechanically and magnetically coupled to each other through a shared coupling leg. This armature outline or geometry is often referred to as E-shaped.

The first and second armature layers of the present multi-layer armature preferably comprise, or are entirely fabricated in, magnetically permeable materials such as ferromagnetic materials. Each of the first and second armature layers may be fabricated as uniform separate components that are attached to each other by one of the above-described attachment methods during subsequent fabrication steps.

The present multi-layer armature may naturally comprise further armature layers in addition to the two separate armature layers described above so as to provide a multi-layer armature with three, four or even more separate layers. In one such embodiment the multi-layer armature comprises a third armature layer having a third surface positioned adjacently to the first surface or the second surface. The displacement region is configured to provide relative displacement between the first, second and third armature layers in a predetermined direction. The above-described features of the displacement region may generally be applied to the three-layer armature embodiment as well.

The armature layers may have substantially identical thicknesses in some embodiments of the present multi-layer armature or different thicknesses in other embodiments of the invention. If the layer thickness is different, each of the outermost layers is preferably thinner than the inner or middle layer or layers. The outermost layers may also be shorter than the inner/middle layer or layers so that a distant portion of a deflectable armature leg consists of a single armature layer only. This reduces a moving mass of the distant portion of the deflectable armature leg without any noticeable penalty in overall magnetic reluctance of the multi-layer armature since magnetic reluctance in the region close to the drive coil is of primary importance. The thickness of each of the first and second armature layers preferably lies between 25 μm and 200 μm. A third or further armature layers may have similar thicknesses.

A second aspect of the invention relates to a miniature balanced moving armature receiver comprising an elongate drive coil forming a central tunnel or aperture with a central longitudinal axis. A pair of permanent magnet members is oppositely arranged within a magnet housing so as to form a substantially rectangular air gap in-between a pair of outer surfaces of the permanent magnet members. A multi-layer armature according to any of the above-described armature embodiments further comprises a deflectable leg portion. The deflectable leg portion extends longitudinally and centrally through the central tunnel and the air gap along the central longitudinal axis. A compliant diaphragm is operatively coupled to the deflectable leg portion of the multi-layer armature such as by a drive pin or rod. Vibratory movement of the deflectable leg portion is accordingly transmitted via the drive pin or rod to the compliant diaphragm so as to generate a corresponding sound pressure. The miniature balanced moving armature receiver preferably comprises a housing or casing enclosing and protecting the above-mentioned internal components against the external environment to provide shielding against environmental factors such as EMI, fluids, humidity, dust, mechanical impacts and forces etc. The housing may be shaped and sized for use in hearing instruments or similar size-constrained portable applications.

BRIEF DESCRIPTION OF THE DRAWINGS

A preferred embodiment of the invention will be described in more detail in connection with the appended drawings, in which.

DETAILED DESCRIPTION OF PREFERRED EMBODIMENTS

The balanced moving armature receivers that are described in detail below are specifically adapted for use as miniature receivers or speakers for hearing instruments. However, the novel features of the disclosed miniature balanced armature receivers may be applied to receivers tailored for other types of applications such a portable communication devices and personal audio device.

Figure 1A:
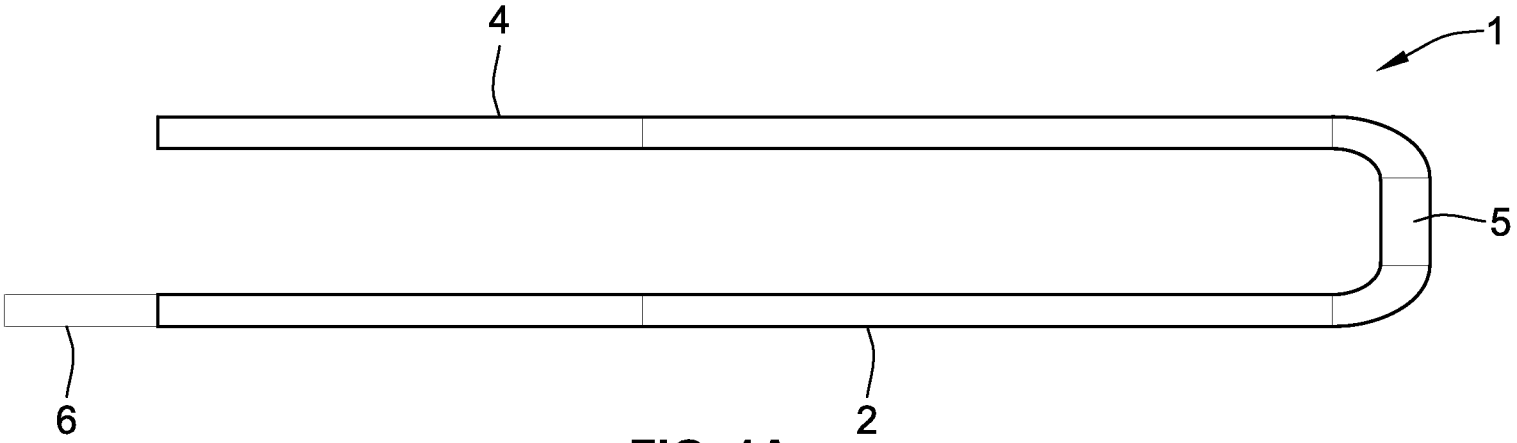
FIG. 1A (PRIOR ART)
FIGS. 1*a*) and 1*b*) are cross-sectional views of a prior art U-shaped armature and a U-shaped armature in accordance with a first preferred embodiment of the invention, respectively.

FIG. 1*a*) illustrates a prior art U-shaped armature 1 in central cross-sectional view taken vertically through the armature relative to a horizontal plane extending parallelly (in a parallel manner) with a first leg portion 4 and a second essentially parallel leg portion 2. The prior art U-shaped armature 1 comprises a first leg portion 4 and a second leg portion 2 that are substantially parallel to each other. The first and second leg portions 2, 4 are mechanically and magnetically coupled to a curved segment 5 of the armature. A distant leg portion 6 of the second armature leg portion 2 is configured for attachment of a drive pin or rod (not shown) for transmission of vibratory motion of the distant leg portion 6 to a receiver diaphragm (not shown) as explained in further detail below in connection with FIG. 2. The U-shaped armature 1 is conventionally fabricated by machining and bending of a single flat piece of ferromagnetic material.

Figure 1B:
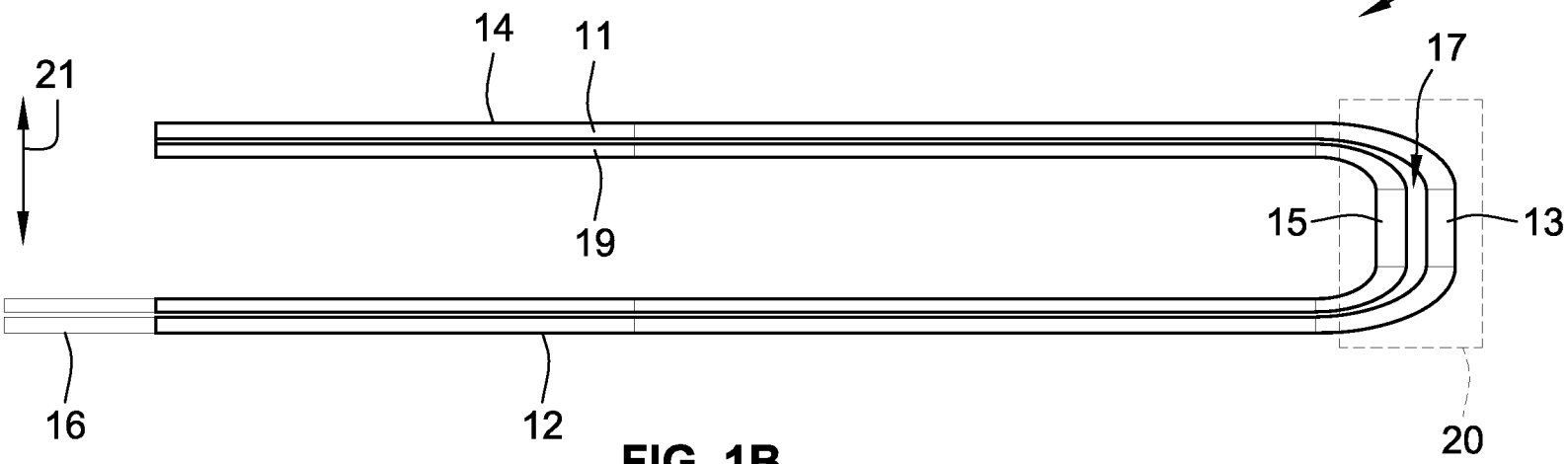

FIG. 1*b*) illustrates a substantially U-shaped multi-layer armature 10 in accordance with a first preferred embodiment of the invention. The U-shaped armature 10 is shown in a central cross-sectional view taken vertically through the armature relative to a horizontal plane extending parallelly with a first leg portion 14 and a second leg portion 12 extending essentially parallelly thereto. The U-shaped multi-layer armature 10 comprises a first or outer armature layer 11 and a second or inner armature layer 19 positioned adjacently to each other with a pair of essentially flat and facing surfaces. A displacement region 20 comprises a first curved segment 15 of the inner armature layer 19 spaced apart from a second curved segment 13 of the outer armature layer 11 by a small air gap 17. A height of the air gap 17 may vary along the displacement region for example varying between 20 μm and 100 μm. Selected areas of the facing surfaces of the outer armature layer 11 and inner armature layer 19 are abutted and firmly attached to each other by welding outside the displacement region 20 such as surface areas along edge portions of the facing surfaces to ensure good magnetic coupling between the inner and outer armature layers.

The geometrical relationship between the first and second curved segments 13, 15 means that they have a small length difference which allows relative or independent displacement between the first and second curved segments 13, 15 during magnetic actuation of the multi-layer armature 10 while retaining good magnetic coupling between the first and second armature layers. This magnetic actuation induces reciprocating relative movement or vibration between the first leg portion 14 and the second leg portion 12 in the vertical direction indicated by arrow 21.

To illustrate some of the possible performance benefits associated with the present invention, consider an embodiment where a thickness of each of the outer and inner armature layers 11, 19 including the curved segments 13, 15 is set to about one-half of the thickness of the conventional U-shaped armature 1 of FIG. 1*a*) for identical outer dimensions of the present multi-layer armature 10 and the conventional armature 1. Assuming good magnetic coupling between the outer and inner armature layers 11, 19, the total magnetic reluctance of the multi-layer armature 10 is largely unchanged relative to the conventional armature 1. However, a halving of the armature thickness leads to a decrease of about $2^3$ (factor 8) of mechanical stiffness according to equation (2) below, for mechanical stiffness of a cantilever beam fixed at one end.

The deflection z at a magnetic force point of the armature is:

$$z = \frac{4 \cdot l_{arm}^3}{E_{arm} \cdot w_{arm} \cdot t_{arm}^3} \cdot F_{arm}[\mathrm{m}] \qquad \text{Equation (1)}$$

Where:

$l_{arm}$: armature length [m]

$w_{arm}$: armature width [m]

$t_{arm}$: armature thickness [m]

$E_{arm}$: Young's modulus of the armature [Pa]

$F_{arm}$: force on armature [N]

For a solid armature its mechanical stiffness is inversely proportional to the third power of its thickness, $t_{arm}$:

$$k_{armature} = \frac{E_{arm} \cdot w_{arm} \cdot t_{arm}^3}{4 \cdot l_{arm}^3}[\mathrm{N/m}] \qquad \text{Equation (2)}$$

Consequently, it is possible to decrease the mechanical stiffness with a factor of about four by replacing a conventional armature of a certain thickness with a dual-layer armature, having substantially the same outer dimensions, but fabricated as two independently displaceable armature layers, or armature regions, each with one-half of the thickness of the conventional armature.

This fact leads to vastly improved performance of the multi-layer armature 10 compared to conventional armatures for similar outer dimensions such as length and width.

Clearly, the improved performance may exploited to improve either a single or several specific performance aspect(s) at the same time in a very flexible manner for example by decreasing the armature length and decreasing the mechanical stiffness at the same time.

Figure 2:
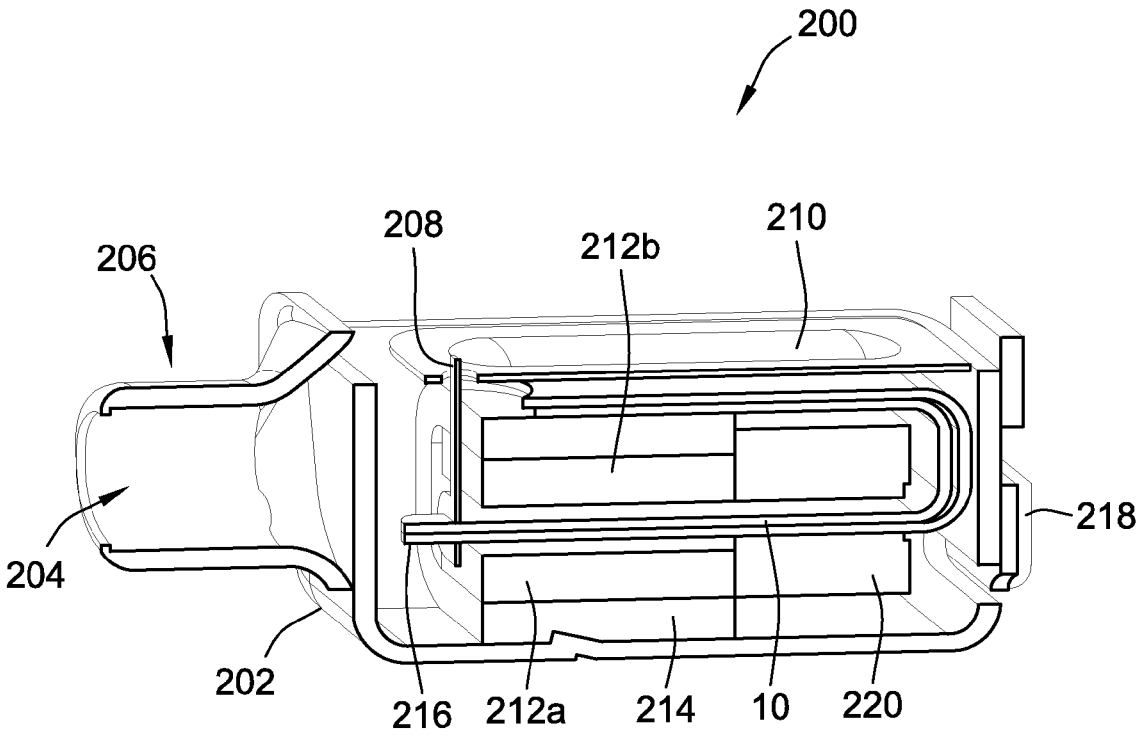
FIG. 2 is a cross-sectional view of an exemplary balanced moving armature receiver comprising the U-shaped armature depicted on FIG. 1*b*) in accordance with a second aspect of the invention.

During operation of the multi-layer armature 10 depicted on FIG. 1 in a moving armature receiver, such as in the balanced miniature moving armature receiver 200 illustrated on FIG. 2, the first leg portion 14 of the multi-layer armature 10 is rigidly attached to a magnet housing or other stationary component(s) of the moving armature receiver. The fixation of the first leg portion 14 means that the second leg portion 12 vibrates relative to the components or parts of the receiver in accordance with the magnetic actuation of the multi-layer armature 10. A distant leg portion 16 of the second leg portion 12 exhibits the largest vibration amplitude and protrudes horizontally from the first leg portion 14 so that it may be operatively coupled to a diaphragm of the moving armature receiver as explained in further detail below. The multi-layer armature 10 is preferably assembled from armature layers that are highly magnetically conductive such as a composition or alloy with 50% Fe and 50% Ni. The dimensions of the multi-layer armature 10 may vary according to the particular application in question. In the illustrated embodiment, a total length of the multi-layer armature 10 is preferably between about 3 and 7 mm. A total height of the multi-layer armature 10 is preferably set to about 1 to 2 mm. The respective length and height dimensions may be varied depending on the receiver type and the adapted to the specific type of application under consideration. The thickness of each of the outer and inner armature layers 11, 19, respectively, may be set to a value between 50 μm and 150 μm.

FIG. 2 is a central vertical cross-sectional view of an exemplary balanced moving armature receiver 200 comprising the U-shaped multi-layer armature 10 depicted on FIG. 1*b*). The first leg portion of the U-shaped multi-layer armature 10 is rigidly fixed to an upper portion of a magnet housing 214 for example by welding or gluing. The second leg portion functions as a deflectable leg portion which extends centrally through a coil tunnel formed by a drive coil 220 and an adjacently positioned rectangular magnet tunnel or aperture formed between a pair of opposing substantially rectangular outer surfaces of the permanent magnets 212*a*, 212*b*. A distal end portion 216 of the second leg portion of the multi-layer armature protrudes horizontally out of the magnet tunnel. The distal end portion 216 vibrates in accordance with the AC (alternating current) variations of magnetic flux through the U-shaped multi-layer armature 10. These AC variations of magnetic flux are induced by a substantially corresponding AC drive current in the drive coil 220. A drive pin or rod 208 is attached to the vibratory distal end portion 216 of the deflectable leg so as to transmit vibration to a compliant diaphragm 210 located above the magnet housing. The transmitted vibration generates a corresponding sound pressure above the compliant diaphragm 210 and this sound pressure can propagate to the surrounding environment through a sound opening 204 of the sound port or spout 206. A pair of electrical terminals 218 is placed on a rear side of the receiver housing 202 and electrically connected to the drive coil 220. Sound pressure is generated by the balanced moving armature receiver 200 by applying an electrical audio signal to the pair of electrical terminals 218 either in the form of an unmodulated (i.e. frequency components between 20 Hz and 20 kHz) audio signal or, in the alternative, a modulated audio signal such as a PWM (pulse-width modulation) or PDM (pulse-density modulation) modulated audio signal that is demodulated by mechanical, acoustical and/or electrical low-pass filtering performed by the balanced moving armature receiver 200.

Figure 3:
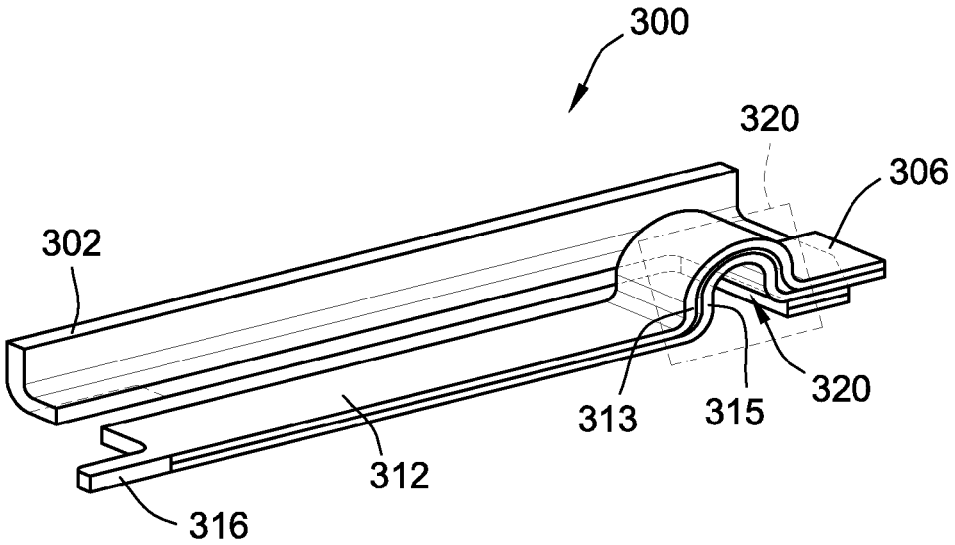
FIG. 3 is a partial cross-sectional view of an E-shaped armature in accordance with a second embodiment of the invention.

FIG. 3 is a partial cross-sectional view of an E-shaped armature 300 in accordance with a second embodiment of the invention. A residual portion of the E-shaped armature 300 may have a shape similar to the shape of E-shaped armature depicted on FIG. 4.

The E-shaped armature 300 comprises a flat elongate armature leg 312 forming a middle or central leg of an E-shaped armature outline. A flat and bent first outer leg 302 extends substantially parallelly with the flat elongate armature leg 312 while a symmetrically positioned and similarly shaped second outer leg has been left out of the illustration for simplicity. The flat elongate armature leg 312 is deflectable relative to a stationary portion of the E-shaped armature and comprises a narrowed distal leg portion 316 that may be used as attachment point for a drive pin or rod. A proximate leg portion 306 is mechanically and magnetically attached to a shared coupling leg or keeper. The shared coupling leg functions to mechanically and magnetically inter-connect the flat elongate armature leg 312 and the first and second flat and bent outer legs.

Figure 4A:
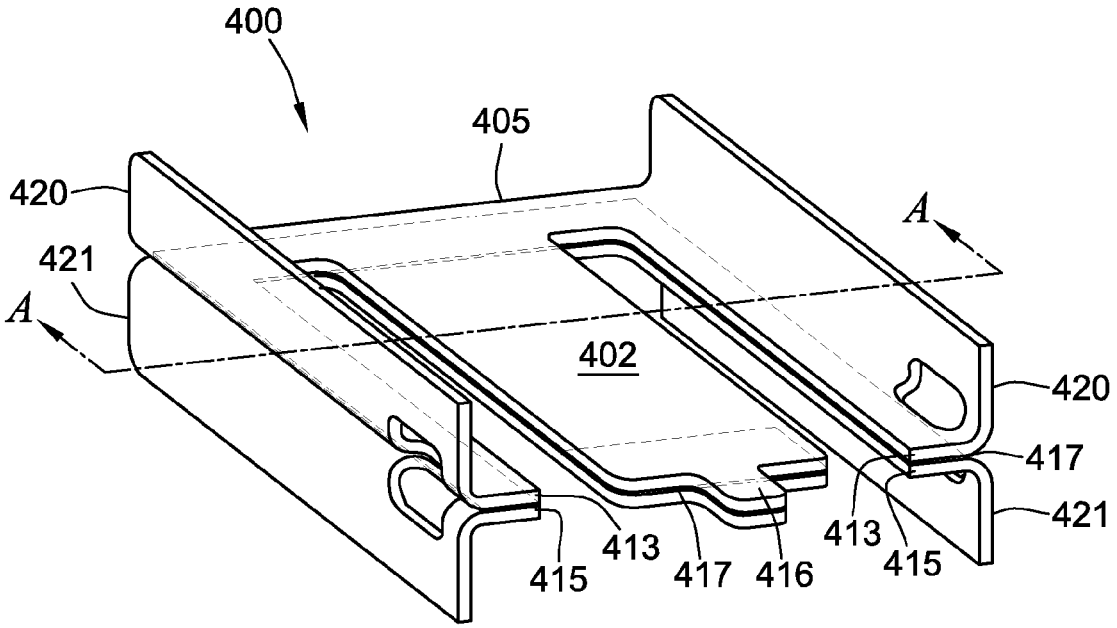
FIGS. 4*a*) and 4*b*) illustrate a perspective view and cross-sectional view, respectively, of an E-shaped armature in accordance with a third embodiment of the invention.

The flat elongate armature leg 312 comprises adjacently positioned upper and lower armature layers having outer surfaces abutted and rigidly attached to each other along the armature leg 312 except for a pair of curved segments 313, 315 located within a displacement region 320. The displacement region 320 comprises the pair of curved armature segments 313 and 315 formed as respective bumps or protrusion projecting vertically from the flat elongate armature leg 312. A small air gap is arranged in-between facing surfaces of the curved armature segments 313 and 315 to allow relative movement or displacement between these. The small air gap may in other embodiments be filled with a displacement agent such as a magnetically conductive agent for example as a gel or oil with ferromagnetic particles or material FIGS. 4*a*) and 4*b*) illustrate a perspective view and a cross-sectional view, respectively, of an E-shaped armature in accordance with a third embodiment of the invention. As illustrated in FIG. 4*a*), the E-shaped armature 400 comprises a first or upper armature layer 413 positioned adjacently to a second or lower armature layer 415. Respective surfaces of the upper and lower armature layers are placed adjacently to each other only separated by a thin intermediate layer or gap 417. As illustrated, the displacement region extends between the first and second armature layers 413, 415 throughout the entirety of their adjacent surface areas as opposed to the embodiment disclosed above in connection with FIG. 3 where the displacement region 320 is limited to a certain sub-section of the E-shape armature 300.

Each of the upper and lower armature layers 413, 415 furthermore comprises a pair of bent upwardly or downwardly extending flaps or elbows 420, 421, respectively. The flaps 420, 421 form part of a pair of outer armature legs and may be used as attachment surfaces for the E-shaped armature 400 to rigidly couple or attach the armature 400 to a stationary portion of a moving armature receiver such as a magnet housing as explained in further detail above. A flat elongate second or middle armature leg 402 is positioned in-between the first and second outer armature legs which each comprises the upwardly and downwardly extending flaps 420, 421.

The E-shaped armature 400 accordingly comprises first, second and third substantially parallel leg portions that are mechanically and magnetically coupled to each other through a shared coupling leg or back 405. The flat middle armature leg 402 is deflectable and comprises a narrowed distal leg portion 416 that may be used as attachment point for a drive pin or rod in a manner similar to the one explained above in connection with FIG. 3. As previously explained in connection with FIG. 1, the independent displacement between the upper and lower armature layers 413, 415 within the deflectable central armature leg 402 leads to a decrease of about 4 of the mechanical stiffness of the leg 402 compared to a similar sized and shaped displaceable leg of conventional armature.

A height or thickness of the thin intermediate layer or gap 417, and thereby the distance between the facing surfaces of the upper and lower armature layers, may vary depending on a size of the E-shaped armature and the type of displacement agent, if any, disposed within the gap 417. The thickness should generally be as small as practically possible to provide good magnetic coupling between the upper and lower armature layers 413, 415, but still sufficiently large to allow at least partially free relative displacement between the armature layers in a longitudinal plane extending parallelly to the flat surface of the middle armature leg 402. The thickness is preferably set to a value between 0.1 μm and 10 μm such as between 1 μm and 3 μm if the displacement agent is air. If the intermediate layer comprises a magnetically conductive agent such as a gel or oil with ferromagnetic particles or material, the thickness may be set to a value between 0.1 μm and 50 μm such as between 10 μm and 30 μm. However, to prevent the upper and lower armature layers 413, 415 from completely separating, certain mechanical layer stops or layer retaining structure(s) are preferably provided. Such layer retaining structure(s) may comprise a weld positioned at a selected location along the middle armature leg 402 and/or a clamp or adhesive film fitted around the middle armature leg 402. The layers are preferably not fully magnetically isolated from each other by the thin intermediate layer or gap 417 to avoid hampering magnetization of the armature 400.

Figure 4B:
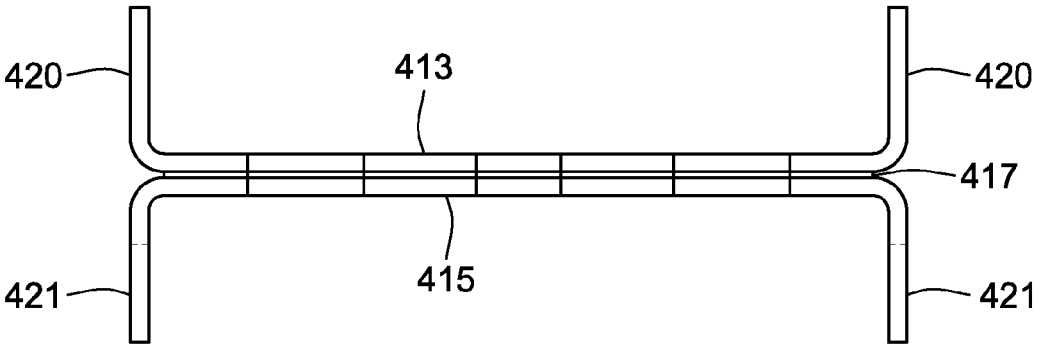

FIG. 4*b*) is a cross-section view taking along dotted line "A" of FIG. 4*a*) of the E-shaped armature 400. The thin or intermediate layer or gap 417 extends horizontally through the pair of outer armature legs and the central flat displaceable armature leg. The upper and lower armature layers 413, 415 are clearly visible and illustrates that the displacement region is the present embodiments extends throughout the entire adjacent or facing surface areas of the upper and lower armature layers 413, 415. However, in other embodiments of the invention, the displacement region, with an intermediate layer, is confined to the middle armature leg 402.

The invention claimed is:

1. A multi-layer armature for a moving armature receiver comprising:

a first armature layer comprising a first surface and a second armature layer comprising a second surface positioned adjacently to the first surface, and a displacement region configured to provide relative displacement between the first and second armature layers in a predetermined direction.

2. A multi-layer armature according to claim 1, wherein the displacement region comprises:

a curved segment of the first armature layer and a curved segment of the second armature layer, wherein the curved segments have different length.

3. A multi-layer armature according to claim 1, wherein the displacement region comprises an air gap separating the first and second surfaces of the first and second armature layers.

4. A multi-layer armature according to claim 1, wherein the displacement region comprises a displacement agent, other than air, arranged in-between the first surface of the first armature layer and the second surface of the second armature layer.

5. A multi-layer armature according to claim 4, wherein the displacement agent comprises a ferromagnetic material.

6. A multi-layer armature according to claim 4, wherein the displacement agent comprises a material selected from a group of {polymer, gel, ferrofluid, adhesive, thin film}.

7. A multi-layer armature according to claim 2, wherein each of the first and second armature layers comprises:

first and second substantially parallel leg portions mechanically and magnetically coupled to the curved segments of the displacement region to form a substantially U-shaped multi-layer armature.

8. A multi-layer armature according to claim 2, wherein each of the first and second armature layers comprises:

a flat elongate armature leg having a distant leg portion and a proximate leg portion, wherein the curved segments of the first and second armature layers are formed as respective bumps on the proximate leg portion.

9. A multi-layer armature according to claim 3, wherein the displacement region extends between the first and second surfaces throughout entire adjacent surface areas of the first and second armature layers.

10. A multi-layer armature according to claim 9, wherein each of the first and second armature layers comprises:

first, second and third substantially parallel leg portions mechanically and magnetically coupled to each other through a shared coupling leg.

11. A multi-layer armature according to claim 1, wherein surface portions of the first and second surfaces outside the displacement region are rigidly attached to each other for example by welding, soldering, gluing, press fitting, etc.

12. A multi-layer armature according to claim 1, wherein a distance between the first and second surfaces in the displacement region lies between 0.1 μm and 100 μm or between 10 μm and 100 μm.

13. A multi-layer armature according to claim 1, wherein the first and second armature layers comprises ferromagnetic materials.

14. A multi-layer armature according to claim 1, further comprising a third armature layer comprising a third surface positioned adjacently to the first surface or the second surface, wherein the displacement region is configured to provide relative displacement between the first, second and third armature layers in a predetermined direction.

15. A multi-layer armature according to claim 1, wherein all armature layers have substantially identical thickness.

16. A multi-layer armature according to claim 14, wherein a thickness of a middle armature layer is smaller than a thickness of each of the outermost armature layers.

17. A multi-layer armature according to claim 1, wherein a thickness of each of the first and second armature layers lies between 25 μm and 200 μm.

18. A multi-layer armature according to claim 1, wherein the first and second armature layers are closely magnetically coupled to each other to minimize magnetic reluctance between the first and second armature layers.

19. A miniature balanced moving armature receiver comprising:

an elongate drive coil forming a central tunnel or aperture with a central longitudinal axis, a pair of permanent magnet members oppositely arranged within a magnet housing so as to form a substantially rectangular air gap in-between a pair of outer surfaces of the permanent magnet members, a multi-layer armature according to any of the preceding claims comprising a deflectable leg portion, said deflectable leg portion extending longitudinally and centrally through the central tunnel and the air gap along the central longitudinal axis, and a compliant diaphragm operatively coupled to the deflectable leg portion of the multi-layer armature.

20. A multi-layer armature according to claim 1, wherein the predetermined direction of the relative displacement between the first and second armature layers is along corresponding facing surfaces of the first and second armature layers.

* * * * *